United States Patent [19]

Cancilla

[11] 4,111,799

[45] Sep. 5, 1978

[54] STOCK SCREEN FOIL

[75] Inventor: Vincent W. Cancilla, Pittsfield, Mass.

[73] Assignee: Beloit Corporation, Beloit, Wis.

[21] Appl. No.: 813,700

[22] Filed: Jul. 7, 1977

[51] Int. Cl.[2] ..... B03B 5/56

[52] U.S. Cl. ..... 209/273; 209/379; 210/407

[58] Field of Search ..... 209/270, 273, 306, 379, 209/383, 385, 389; 210/407–408, 412–415

[56] References Cited

U.S. PATENT DOCUMENTS

| | | | |
|---|---|---|---|
| 2,835,173 | 5/1958 | Martindale | 209/270 |
| 3,029,951 | 4/1962 | Cannon | 210/408 |
| 3,082,874 | 3/1963 | Justus | 210/333 |
| 3,456,793 | 7/1969 | Salomon | 209/306 |
| 4,043,919 | 8/1977 | Hutzler | 210/407 |

*Primary Examiner*—Tim R. Miles
*Assistant Examiner*—Jon Hokanson
*Attorney, Agent, or Firm*—Hill, Gross, Simpson, Van Santen, Steadman, Chiara & Simpson

[57] ABSTRACT

A mechanism for screening a stock slurry for a paper making machine including a cylindrically shaped tubular screen with a stock supply at one end and a discharge at the opposite end for rejected stock and an annular receiving chamber outwardly of the screen for material which passes the screen and rotating axially extending foils within the screen, each foil having a rib projecting radially inwardly and extending in a helical direction at an angle to the foil to move the stock from the supply end of the screen to the discharge end.

9 Claims, 3 Drawing Figures

Fig. 1
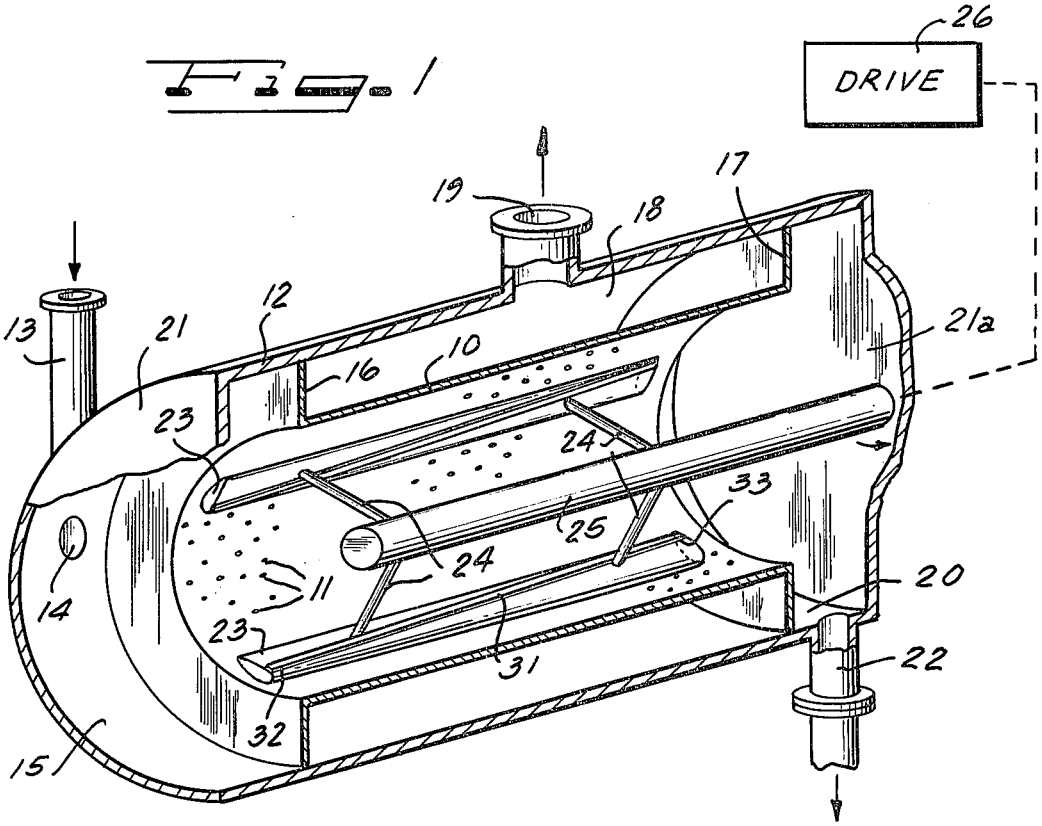
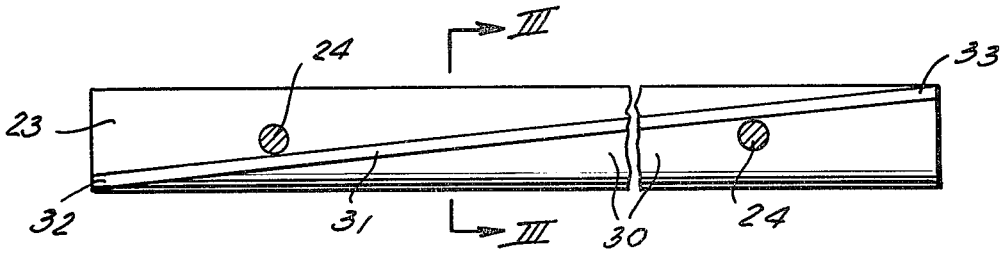
Fig. 2
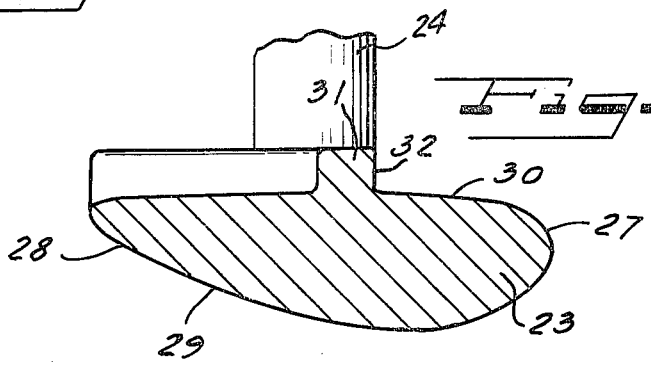
Fig. 3

STOCK SCREEN FOIL

BACKGROUND OF THE INVENTION

The invention relates to improvements in paper machine stock screens, and more particularly to an improvement in a foil construction which aids in movement of the stock through the screening mechanism.

Stock screens are used in the paper making process for aiding in cleaning the stock before it flows to the headbox to be dewatered to form a web. Such stock screens are conventionally tubular in shape with the stock being directed either to the inner surface or the outer surface of the tubular screen with the accepted stock flowing through the screen and the rejected stock including sheaves, particles, dirt and knots, not passing through the screen and flowing to the other end to be removed through a reject line. Typically, the stock to be screened is admitted at one end of the tubular screen, and the rejects flow out of the other end while the accepts are received by an annular chamber, with the annular chamber surrounding the screen in the case where the supply stock is delivered to the inside of the screen and the stock flows outwardly through the screen in the screening operation. Such devices are shown in U.S. Pat. No. 3,082,874, Justus, and U.S. Pat. No. 3,456,793, Salomon. In commercial operation, the screen will operate under pressure and stock will be pumped into one end of the tubular screen to enter the interior of the screen tangentially, and the pressurized screen will operate under a wide range of stock velocity. For aiding in the rapid flow of acceptable stock through the screen and preventing the fibers from building up on the screen surface, shaped foils are continuously moved around along the surface of the screen. Such foils have a rounded leading edge and a tapered trailing edge so that as they move along the screen, they create a pressure pulsation to cause a dispersal of the fibers and aid in the screening operation. These foils dispense the individual fibers for maximum screening efficiency employing a combination of centrifugal force, pressure differential and hydraulic action. The accepted fibers which flow through the screen are captured in an annular chamber and flow to the headbox or to a vat. The rejected fibers and lightweight impurities are directed toward a low pressure light rejects outlet at the lower end of the screen. To aid in the screening operation, it is desirable that the material being screened flow in an axial direction along the screen surface from the inlet end toward the discharge end. Attempts have been made to increase this flow and make it more uniform by constructing angular foils that extend in a generally helical direction such as shown in Martindale U.S. Pat. No. 2,835,173, U.S. Pat. No. Re. 24,677. However, because the foils have a critical shape, they are usually made by machining, or by a casting operation, and it is difficult and expensive to maintain the optimum shape and form the foils generally helical because of the difficulty of generating the helical shape of a foil along a cylindrical surface. Such machining is, therefore, prohibitive and the costs outweigh the advantages.

In accordance with the present invention, a structure has been provided wherein the foils can be manufactured by the standard less expensive method to extend axially, and yet they can be utilized to obtain a pumping action which causes the stock to flow axially along the screen surface. According to the invention, vane means are located on the surface of the screen, and extend in a helical direction so that they cause a flow of the stock from the delivery end of the screen toward the reject end. The vane preferably is in the form of a continuous rib on the surface of the vane facing away from the screen so that the rib in no way adversely affects the performance of the vane, and yet permits the vane to be made by less expensive machining methods without the necessity of machining the combined complex shape that is necessary to provide an airfoil configuration that extends helical.

Accordingly, an object of the present invention is to provide an improved stock screening mechanism for a paper making machine wherein the axial movement of the stock through a tubular screen is enhanced, and the screening function is improved.

A still further object of the invention is to provide a commercially practical pressure stock screen wherein the airfoil members which are moved along the surface of the screen can be of optimum design and be manufactured relatively reasonably, and yet the mechanism for moving the foils and the movement of the foils is utilized for moving the stock axially through the tubular screen.

Other objects and advantages and features of the invention, as well as equivalent structures which are intended to be covered herein, will become more apparent with the disclosure of the preferred embodiment in the specification, claims and drawings in which:

DRAWINGS

FIG. 1 is a perspective view with portions broken away showing the interior of a screening mechanism constructed and operating in accordance with the principles of the present invention;

FIG. 2 is a plan view of the inside of one of the vanes of the mechanism of FIG. 1; and FIG. 3 is an enlarged sectional view taken substantially along line III—III of FIG. 2.

DESCRIPTION

As illustrated in FIG. 1, a paper machine screening mechanism has a cylindrically shaped tubular screen 10 with perforations 11 therethrough of a size selected to pass acceptable fibers and to reject nonacceptable fibers and foreign material such as dirt, sheaves and knots.

The tubular screen 10 is mounted within a housing 12 which has end walls 21 and 21*a*. The drawing illustrates the mechanism as positioned horizontally, but frequently a screening mechanism such as this is positioned vertically with the supply stock being fed to the top end and the rejects being removed at the bottom end. The housing is so arranged that a supply chamber 15 is provided at the supply end of the screen, and a supply conduit 13 leads through a tangential opening 14 into the supply chamber 15 for the supply of stock to flow tangentially into the screen. The stock, as indicated by the arrowed lines through the chamber 15, flows into the supply end of the screen and flows along the length of the screen with the acceptable stock and fibers passing through the openings 11 through the screen, and the rejects flowing to an annular reject chamber 20 and out through a reject line 22. Screening of the stock is enhanced if it is moved relatively rapidly along the length of the screen and if a pumping action is attained so as not only to rely on the pressure differential to cause flow along the screen length. The acceptable fibers flow into an annular chamber 18 surrounding the screen formed by end walls 16 and 17 and the outer wall of the housing 12. A conduit 19 receives the passed fibers to flow to a paper machine headbox or a vat.

Within the screen are foils 23 which extend axially parallel to the axis of the screen. These foils, as illustrated in FIG. 3, have an airfoil shape in cross-section with a rounded nose end 27 and a trailing tapered edge 28. As the foil moves along the screen surface, a pressure pulsation is generated which aids in the screening operation and to obtain the airfoil shape, the foils are carefully designed and machined. The foils are supported on radial arms 24 extending from a central shaft 25 which is driven in rotation by a drive mechanism shown schematically at 26. The drive shaft is supported on bearings supported in the end walls 21 and 21*a*.

The foil has an outer surface 29, FIG. 3, which faces the screen, and an inner surface along which extends a vane means or rib 31. The rib may be welded to the inner surface 30 of the vane or may be integral therewith if the vane is originally cast, and subsequently the outer surface 29 machined.

The rib 31 or vane is preferably continuous and extends in a spiral direction so that as the vanes are moved, the leading surface 32 generates a pumping action tending to move the stock within the screen in an axial direction from the supply end to the discharge end which is at the discharge chamber 20. The rib 31 does not interfere with the functional operation of the outer surface 29 of the foil which creates a pumping or pulsating action in the screen as it passes, and the foil is made to extend in an axial direction. With a straight axial foil, the expense of attempting to make a helical shaped foil is avoided. Further, it is believed that the helical shape is not as effective as an axially shaped foil and full attention and importance in the foil shape can be given to its function relative to the pulsations in the screen, and the optimum shape does not have to be compromised to attempt to obtain axial movement of the stock. A plurality of vanes or ribs on each foil could be equally effective.

As will be apparent to those versed in the art, such plurality of ribs would be attached to the foils in the same manner as the single rib which is illustrated and would usually be parrallel to each other and be of the same size and shape. While the foils with the pumping ribs are shown in a screening arrangement where the foils are moved within the inner surface of the screen, it will be recognized from the foregoing that foils which move past the outer surface of the screen may also employ the principles of the invention by positioning the rib on the surface facing away from the screen. The foil design is the primary use in screens, but can be used in classifiers and other paper making machinery wherein a foil is moved past a screen surface.

Thus, it will be seen that I have provided a mechanism which meets the objects and advantages above set forth and provides an improved screening operation and reduction of cost of manufacture.

I claim as my invention:

1. A mechanism for screening a stock slurry for a paper making machine comprising in combination:

a cylindrically shaped tubular screen;

a generally annular housing having end walls and surrounding the screen providing an outer chamber outside of the screen for receiving acceptable slurry;

supply means for supplying stock to the housing at one end of the screen to flow into the interior;

stock receiving means receiving stock from the housing chamber outside of the screen;

discharge means at the end of the screen opposite the supply means for receiving material not passing through the screen;

an axially extending foil member movable circumferentially along the screen for generating pressure pulsations having a radial outer surface facing the screen and a radial inwardly facing surface facing away from the screen;

and a circulation vane positioned solely one said inwardly facing surface of the foil projecting radially inwardly and extending in a generally helical direction for generating flow axially of the screen from the supply end to the discharge end without disturbing the action of the outer surface of the foil on the screen.

2. A mechanism for screening a stock slurry for a paper making machine constructed in accordance with claim 1:

wherein said foil extends axially substantially parallel to the axis of the screen and said circulation vane is in the form of a continuous rib for generating the axial flow of stock.

3. A mechanism for screening a stock slurry for a paper making machine comprising in combination:

a perforate screen to which stock is supplied to a surface of the screen with a portion of the stock passing through the screen and a portion not passing the screen and flowing in a discharge direction;

a foil movable along said surface of the screen having an outer surface facing the screen for creating a pressure pulsation in the screen to aid in the passage of stock therethrough and having an inwardly facing surface away from the screen;

and a vane means on the foil extending in a direction for generating movement of the stock along said surface in a discharge direction and being soley on said inwardly facing surface so that the action of the outer surface of the foil on the screen is not disturbed.

4. A mechanism for screening a stock slurry for a paper making machine comprising the combination:

a cylindrically shaped tubular screen having an inwardly facing surface to which the stock is supplied with a portion of the stock flowing through the screen and a portion of the material not passing the screen and flowing in a discharge direction toward a discharge end of the screen;

supply means for supplying stock to a supply end of the screen into the interior thereof;

receiving means receiving stock passing through the screen;

a discharge means at the discharge end of the screen receiving material not passing through the screen;

an axially extending foil movable along the screen having a radially outwardly facing surface for generating pressure pulsations in the screen and having a radially inwardly facing surface;

drive means for moving the foil rotationally along the screen;

and a circulation vane means carried solely on said inner surface on the foil for generating the flow axially of the screen from the supply end to the discharge end without disturbing the action of the outer surface of the foil on the screen.

5. A mechanism for screening a stock slurry for a paper making machine constructed in accordance with claim 4:

wherein said vane is in the form of a continuous rib extending in a helical direction.

6. A mechanism for screening a stock slurry for a paper making machine constructed in accordance with claim 5:

wherein said rib has a height on the order of ½" projecting from the vane.

7. A mechanism for screening a stock slurry for a paper making machine constructed in accordance with claim 4:

including a plurality of foils extending in an axial direction circumferentially spaced from each other and carried on a central shaft connected to said drive means with each of the foils having vane means thereon.

8. A mechanism for screening a stock slurry for a paper making machine constructed in accordance with claim 4:

including an annular chamber surrounding the screen with the receiving means connected to receive flow of stock which passes through the screen from said chamber.

9. A mechanism for screening a stock slurry for a paper making machine constructed in accordance with claim 4:

wherein said supply means includes a conduit leading in a tangential direction relative to the screen for discharging stock to the supply end of the machine.

* * * * *

UNITED STATES PATENT AND TRADEMARK OFFICE

CERTIFICATE OF CORRECTION

PATENT NO. : 4,111,799

DATED : September 5, 1978

INVENTOR(S) : Vincent W. Cancilla

It is certified that error appears in the above-identified patent and that said Letters Patent are hereby corrected as shown below:

Claim 1, in column 4, after line 10, and before line 11, insert the phrase

--drive means for moving the foil rotationally along the screen;--

Signed and Sealed this

*Twenty-fourth* Day of *July 1979*

[SEAL]

*Attest:*

*Attesting Officer*

LUTRELLE F. PARKER

*Acting Commissioner of Patents and Trademarks*